US006092647A

United States Patent [19]

Yeh et al.

[11] Patent Number: 6,092,647

[45] Date of Patent: Jul. 25, 2000

[54] BEVERAGE CONTAINER WITH RECEPTACLE

[76] Inventors: Frank Yeh, 1019 N. Mayflower St., Anaheim, Calif. 92801; Dwight A. Cline, 1367 Woodcrest, Houston, Tex. 77018

[21] Appl. No.: 08/929,823

[22] Filed: Sep. 15, 1997

[51] Int. Cl.[7] ..... A24F 15/00; B65D 85/10

[52] U.S. Cl. ..... 206/86; 206/87; 206/217; 220/756

[58] Field of Search ..... 206/85, 86, 87, 206/217; 220/756

[56] References Cited

U.S. PATENT DOCUMENTS

| | | | |
|---|---|---|---|
| 2,122,628 | 7/1938 | Tracy | 220/756 |
| 2,355,010 | 8/1944 | Pera | 220/756 |
| 3,526,313 | 9/1970 | Kull et al. | 206/217 |
| 4,588,076 | 5/1986 | Caputo et al. | 206/86 |
| 4,620,631 | 11/1986 | Bartelt | 206/217 |
| 4,852,729 | 8/1989 | Conte | 206/86 |
| 5,671,503 | 9/1997 | Uebelacker | 220/756 |

FOREIGN PATENT DOCUMENTS

| | | | |
|---|---|---|---|
| 2697139 | 4/1994 | France | 206/85 |

*Primary Examiner*—Joseph M. Moy
*Attorney, Agent, or Firm*—Raymond Sun

[57] ABSTRACT

A beverage container assembly is provided having a container body defining an interior chamber, and a well having a hollow interior defining a receiving space. The receiving space further includes an opening through which a cigarette lighter can be passed and retained inside the receiving space. The receiving space has an elongated cross-section and a sealed bottom. The cigarette lighter is vertically oriented when it is retained inside the receiving space.

4 Claims, 4 Drawing Sheets

BEVERAGE CONTAINER WITH RECEPTACLE

BACKGROUND OF THE INVENTION

1. Field of the Invention

The present invention relates to beverage containers, and in particular, to a beverage container that is provided with a receptacle, cavity or receiving space that is adapted to receive, carry or store a cigarette lighter.

2. Description of the Related Art

Beverage containers are currently being used in many different environments. For example, beverage containers are now commonly used inside vehicles, at office or work desks, in garages, at sporting events, and other locations. This common and widespread use of beverage containers is a result of the popular desire by people to carry their favorite beverage(s) with them wherever they go.

However, beverage containers are not the only articles or items that are commonly carried around by people going through their daily routines. Cigarette lighters, combs, pagers, cellular phones, wallets and purses are just a few simple examples of items that a typical person is more likely to carry around on a daily basis. A person typically carries some of these items inside shirt or trouser pockets, or inside handbags, belt pouches, or other carrying bags. To further ease the inconvenience of carrying these items around, there have also been provided belt hooks, carrying cases with straps, and other carrying aids to which these items can be attached, or on which these items can be supported or contained. Unfortunately, the number of items that are typically carried by a person is steadily increasing, and there is still a need to provide convenient, effective and safe means for carrying or storing these items.

SUMMARY OF THE INVENTION

It is therefore an object of the present invention to provide a beverage container assembly that carries or stores an item, such as a cigarette lighter.

It is another object of the present invention to provide a beverage container assembly that allows the stored or carried item to be used conveniently without impacting the stability and use of the beverage container.

The objects of the present invention may be achieved by providing a beverage container assembly having a container body defining an interior chamber, a well having a hollow interior defining a receiving space, the receiving space further including an opening through which a cigarette lighter can be passed and retained inside the receiving space. The receiving space has an elongated cross-section and a sealed bottom. The cigarette lighter is vertically oriented when it is retained inside the receiving space.

According to one embodiment of the present invention, the well is provided in the form of a generally vertical gripping portion of a handle that extends from the container body.

According to another embodiment of the present invention, the well is provided along the outer surface of the container body, with a handle extending from the well.

According to yet another embodiment of the present invention, the well is provided along the outer surface of the container body, at a location separate from a handle.

According to a further embodiment of the present invention, the well is provided along the inner surface of the container body inside the interior chamber.

In one preferred embodiment of the present invention, the container body, the handle and the well are provided in one piece.

Thus, the assemblies according to the present invention provide a receiving space in a well that is positioned along the body of the beverage container. The receiving space securely retains, in a vertical upright orientation, a cigarette lighter that can be used without tilting or otherwise affecting the balance of the beverage container. As a result, an individual can use the beverage container assembly of the present invention to hold both fluids and a cigarette lighter.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention is applicable to all beverage containers, including mugs, cups or other containers. Such beverage containers can be made from any known materials, including without limitation ceramics, plastic, glass, stainless steel, earthenware and porcelain. The term "beverage container" as used herein shall also include beverage receptacles that do not retain liquids but instead retain mugs, glasses, cups or other drinking containers, such as foam receptacles that are used to hold a mug, glass or cup to keep the contents therein warm.

The present invention provides a beverage container having a receptacle, cavity or receiving space that is adapted to receive, carry or store an item that has a separate function and usage, such as a cigarette lighter. The receptacle, cavity or receiving space is provided at a location in the beverage container which allows the cigarette lighter to be used conveniently and in a safe manner, without impacting the stability and use of the beverage container.

Figure 1:
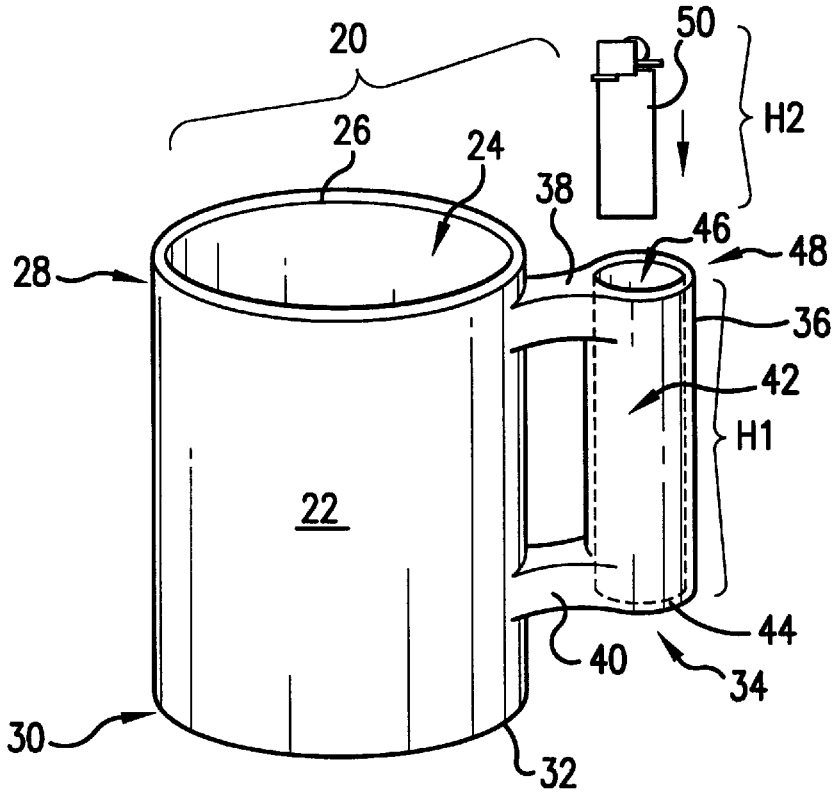
FIG. 1 is a perspective view of a beverage container according to a first preferred embodiment of the present invention which is illustrated as being adapted to carry or store a cigarette lighter.

FIG. 1 illustrates a first embodiment of a beverage container 20 according to the present invention. The beverage container 20 has a generally cylindrical body 22 defining an interior chamber 24, with a mouth 26 at the upper end 28, and with the lower end 30 sealed by the bottom 32 of the beverage container 20. A handle 34 extends from the body 22. The handle 34 is shaped like a conventional "C" shaped handle, having a generally vertical gripping portion 36 and two generally parallel horizontal portions 38 and 40 that connect the gripping portion 36 to the body 22. The gripping portion 36 is provided to be larger than in a conventional handle, and is provided with a hollow configuration so that a void, cavity, receptacle or receiving space 42 (shown in dotted lines) is defined by the hollow gripping portion 36. The gripping portion 36 is sealed at the bottom 44, and has an opening 46 at the top 48 thereof, so that a cigarette lighter 50 can be slipped through the opening 46 and retained inside the receiving space 42.

Figure 1A:
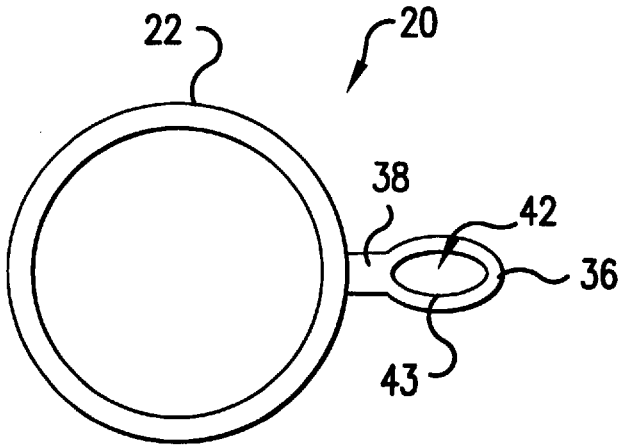
FIG. 1A is a top plan view of the beverage container of FIG. 1.

The receiving space 42 is preferably sized and configured to safely and stably retain a conventional cigarette lighter 50. For example, the receiving space 42 preferably has a vertical height H1 which is substantially the same as the height H2 of a conventional cigarette lighter 50 so that the flame-emitting part of the lighter 50 is outside the vicinity of the receiving space 42. In addition, the internal dimensions, such as the width or the diameter, of the receiving space 42 are sized to accomodate the width or diameter of the conventional cigarette lighter 50. Referring to FIG. 1A, the cross-section of the receiving space 42 is preferably configured with a curved edge 43 defining an elongated cylindrical configuration to receive the thin elongated profile of a conventional cigarette lighter 50. Alternatively, the receiving space 42 can be generally rectangular.

Thus, the cigarette lighter 50 is retained in the receiving space 42 in a manner in which it is supported in a vertical and upright use position. This allows the user to turn on the lighter 50 while he or she is gripping the handle 34. Specifically, the user can lift up the beverage container 20 towards his or her mouth while simultaneously using the thumb to turn on the lighter 50 to light a cigarette. The upright orientation of the lighter 50 inside the receiving space 42 allows the lighter 50 to be securely retained inside the receiving space 42, and to be used without tilting or otherwise affecting the balance of the beverage container 20.

Figure 2:
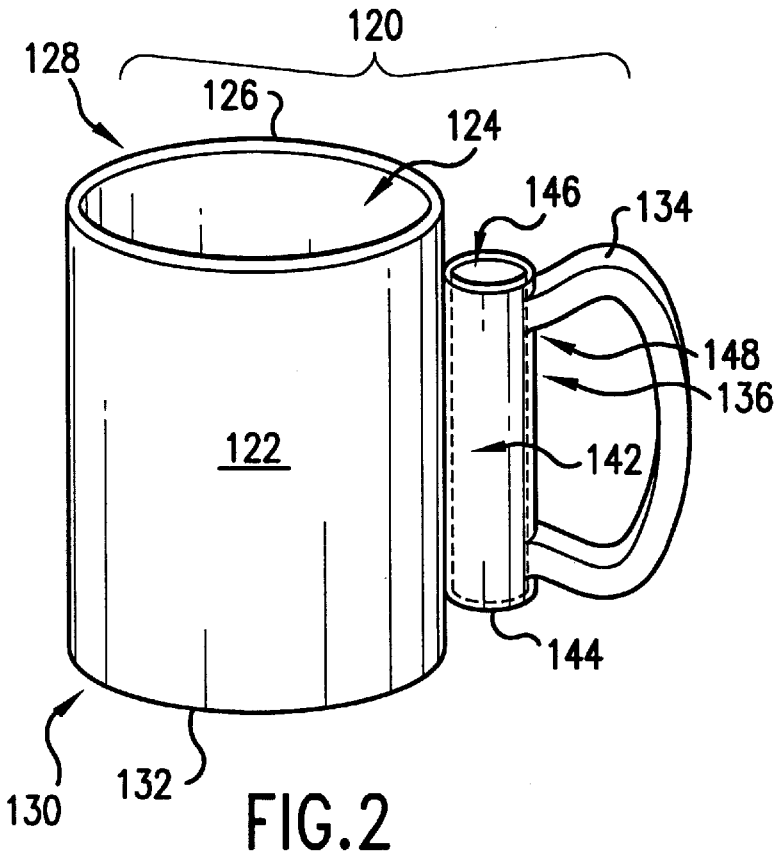
FIG. 2 is a perspective view of a beverage container according to a second preferred embodiment of the present invention.

FIG. 2 illustrates a second embodiment of a beverage container 120 according to the present invention. The beverage container 120 has a generally cylindrical body 122 defining an interior chamber 124, with a mouth 126 at the upper end 128, and with the lower end 130 sealed by the bottom 132 of the beverage container 120. A tubular or rectangular well 136 is provided along the outer surface 133 of the container body 122, and has a hollow configuration so that a void, cavity, receptacle or receiving space 142 (shown in dotted lines) is defined by the hollow well 136. The well 136 is sealed at the bottom 144, and has an opening 146 at the top 148 thereof, so that a cigarette lighter 50 can be slipped through the opening 146 and retained inside the receiving space 142. A handle 134 extends from the well 136 on the side of the well 136 opposite from the side which connects the body 122. The handle 134 can be shaped like a conventional "C" shaped handle. The well 136 can be provided anywhere along the height of the body 122, but is preferably provided at a height such that the top 148 is near the upper end 128 of the body 122.

Figure 2A:
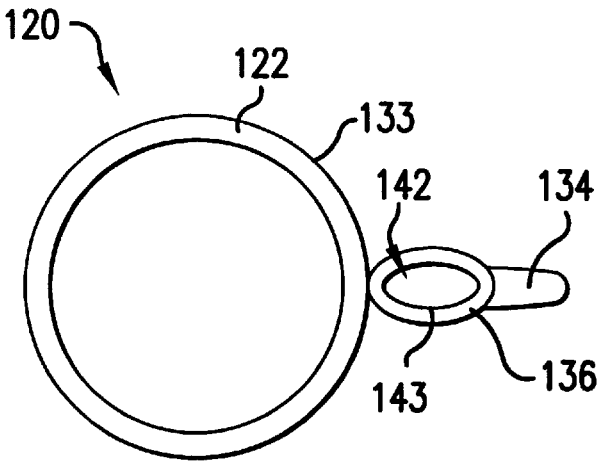
FIG. 2A is a top plan view of the beverage container of FIG. 2.

Receiving space 142 is preferably sized and configured to safely and stably retain a conventional cigarette lighter 50, and its characteristics are similar to those of receiving space 42 described above. Referring to FIG. 2A, the cross-section of the receiving space 142 is also preferably configured with a curved edge 143 defining an elongated cylindrical configuration to receive the thin elongated profile of a conventional cigarette lighter 50. Alternatively, the receiving space 142 can be generally rectangular. Thus, the cigarette lighter 50 is also retained in the receiving space 142 in a manner in which it is supported in a vertical and upright use position, thereby allowing the user to turn on the lighter 50 with the thumb while he or she is gripping the handle 134 with the other fingers. The upright orientation of the lighter 50 inside the receiving space 142 allows the lighter 50 to be securely retained inside the receiving space 142, and to be used without tilting or otherwise affecting the balance of the beverage container 120.

Figure 3:
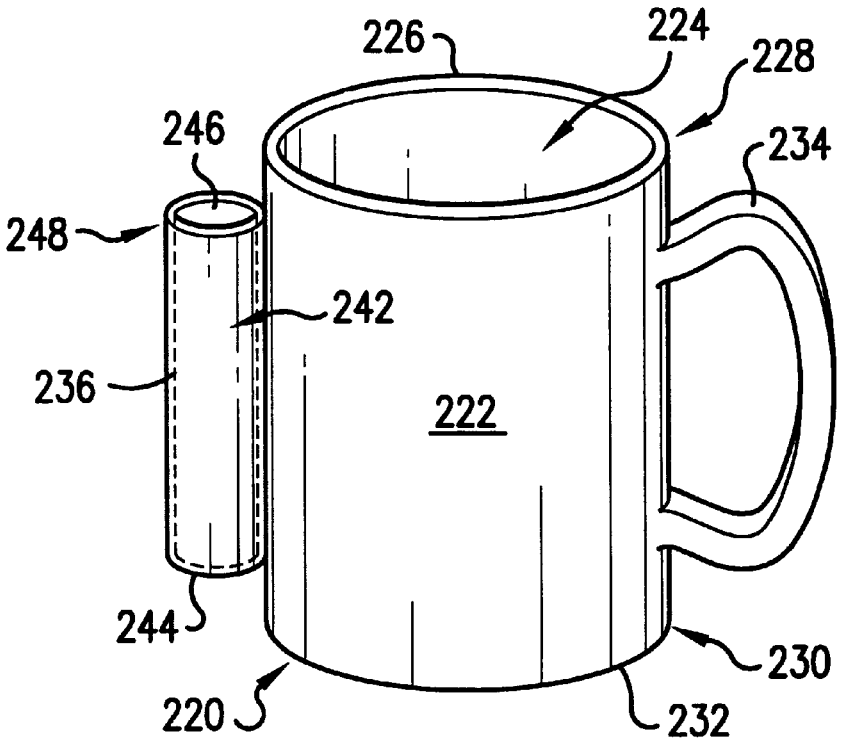
FIG. 3 is a perspective view of a beverage container according to a third preferred embodiment of the present invention.

FIG. 3 illustrates a third embodiment of a beverage container 220 according to the present invention. The beverage container 220 has a generally cylindrical body 222 defining an interior chamber 224, with a mouth 226 at the upper end 228, and with the lower end 230 sealed by the bottom 232 of the beverage container 220. A handle 234 extends from the body 222 and is shaped like a conventional "C" shaped handle. A tubular or rectangular well 236 is provided along the outer surface 233 of the container body 222, and has a hollow configuration so that a void, cavity, receptacle or receiving space 242 (shown in dotted lines) is defined by the hollow well 236. The well 236 is sealed at the bottom 244, and has an opening 246 at the top 248 thereof, so that a cigarette lighter 50 can be slipped through the opening 246 and retained inside the receiving space 242. The well 236 can be provided anywhere along the height of the body 222, but is preferably provided at a height such that the top 248 is adjacent or near the upper end 228 of the body 222. In addition, the well 236 can be positioned anywhere about the circumference of the body 222, even though FIG. 3 illustrates the well 236 positioned generally opposite from the handle 234.

Figure 3A:
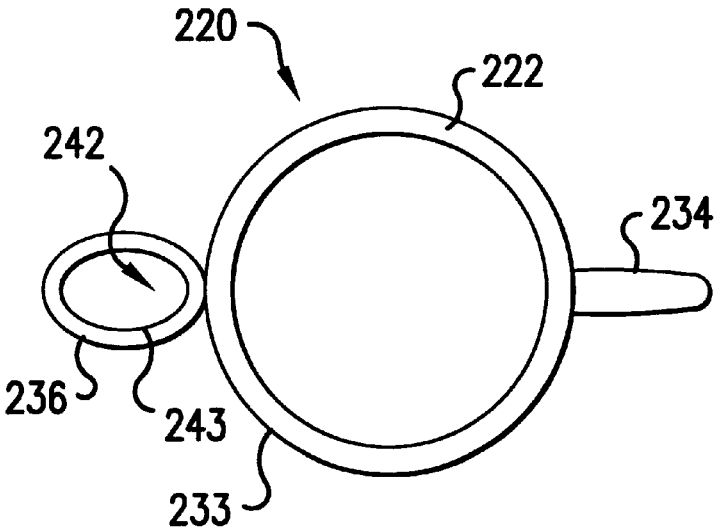
FIG. 3A is a top plan view of the beverage container of FIG. 3.

Receiving space 242 is preferably sized and configured to safely and stably retain a conventional cigarette lighter 50, and its characteristics are therefore similar to those of receiving space 42 described above. Referring to FIG. 3A, the cross-section of the receiving space 242 is also preferably configured with a curved edge 243 defining an elongated cylindrical configuration to receive the thin elongated profile of a conventional cigarette lighter 50. Alternatively, the receiving space 242 can be generally rectangular. Thus, the cigarette lighter 50 is also retained in the receiving space 242 in a manner in which it is supported in a vertical and upright use position, thereby allowing the user to turn on the lighter 50 with the thumb while he or she is gripping the handle 234 with the other fingers. In this regard, it is helpful, though not necessary, if the top 248 of the well 236 is at about the same vertical level as the upper end 228 of the body 222, so that the flame emitted from a lighter 50 will not contact the outer surface 233 of the body 222. The upright orientation of the lighter 50 inside the receiving space 242 allows the lighter 50 to be securely retained inside the receiving space 242, and to be used without tilting or otherwise affecting the balance of the beverage container 220.

Figure 4:
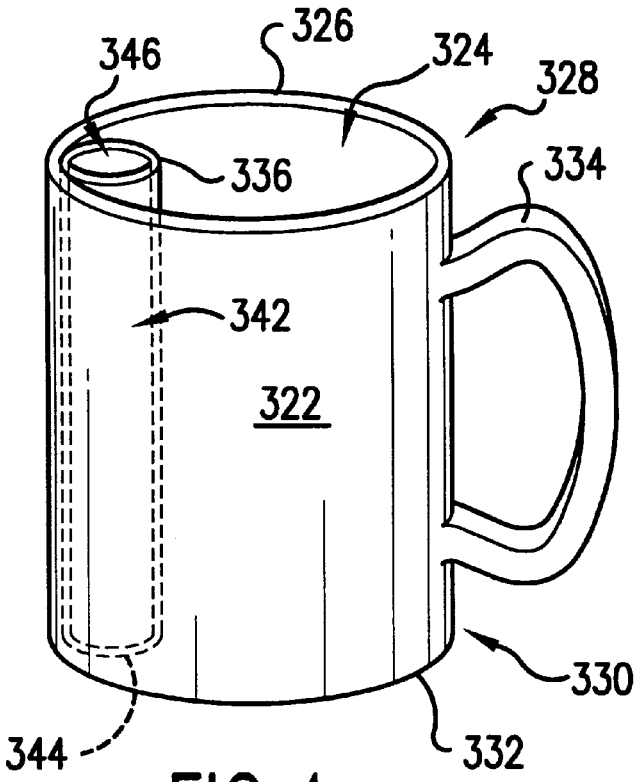
FIG. 4 is a perspective view of a beverage container according to a fourth preferred embodiment of the present invention.

FIG. 4 illustrates a fourth embodiment of a beverage container 320 according to the present invention. The beverage container 320 has a generally cylindrical body 322 defining an interior chamber 324, with a mouth 326 at the upper end 328, and with the lower end 330 sealed by the bottom 332 of the beverage container 320. A handle 334 extends from the body 322 and is shaped like a conventional "C" shaped handle. A tubular or rectangular well 336 is provided along an inner surface 333 of the container body 322 inside the interior chamber 324, and has a hollow configuration so that a void, cavity, receptacle or receiving space 342 (shown in dotted lines) is defined by the well 336. The well 336 may be sealed at the bottom 332 of the beverage container 320, or may have its own bottom 344, as illustrated in FIG. 4. The well 336 also has an opening 346, preferably at the upper end 328 of the beverage container 320, so that a cigarette lighter 50 can be slipped through the opening 346 and retained inside the receiving space 342. The well 336 can be positioned anywhere along the inner circumference of the body 322, even though FIG. 3 illustrates the well 336 positioned generally opposite from the handle 334. For example, the well 336 can even be positioned in the interior chamber 324 adjacent the handle 334.

Figure 4A:
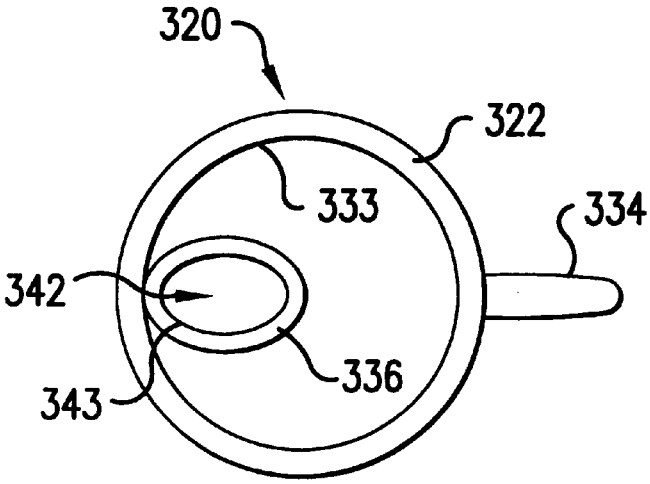
FIG. 4A is a top plan view of the beverage container of FIG. 4.

Receiving space 342 is preferably sized and configured to safely and stably retain a conventional cigarette lighter 50, and its characteristics are again similar to those of receiving space 42 described above. Referring to FIG. 4A, the cross-section of the receiving space 342 is also preferably configured with a curved edge 343 defining an elongated cylindrical configuration to receive the thin elongated profile of a conventional cigarette lighter 50. Alternatively, the receiving space 342 can be generally rectangular. Thus, the cigarette lighter 50 is also retained in the receiving space 342 in a manner in which it is supported in a vertical and upright use position, thereby allowing the user to turn on the lighter 50 with the thumb while he or she is gripping the handle 334 with the other fingers. In this regard, it is preferable that the opening 346 of the well 336 is at about the same vertical level as the upper end 328 of the body 322, so that the flame emitted from a lighter 50 will extend outside the confines of the interior chamber 324. The upright orientation of the lighter 50 inside the receiving space 342 allows the lighter 50 to be securely retained inside the receiving space 342, and to be used without tilting or otherwise affecting the balance of the beverage container 320.

The gripping portion 36 and the wells 134, 234 and 334 that define the receiving spaces 42, 142, 242 and 342, respectively, can be provided in one piece with the respective beverage container 20, 120, 220 and 320. For example, the beverage containers 20, 120, 220 and 320 can be molded from ceramic, plastic or glass in one piece that includes the gripping portion 36 and the wells 134, 234 and 334. Alternatively, gripping portion 36 and the wells 134, 234 and 334 can be provided in separate pieces from the other components of the respective beverage container 20, 120, 220 and 320, and connected together by conventional affixation means.

Although the present invention has been described in connection with the preferred embodiments, it will be appreciated by those skilled in the art that modifications can be made and alternatives utilized without departing from the spirit and scope of the present invention. For example, the configuration and size of the beverage containers 20, 120, 220, 320 are not critical. As a further non-limiting example, the configuration and size of the receiving spaces 42, 142, 242, 342 are not critical, although they should be sized and configured to receive a conventional cigarette lighter 50.

What is claimed is:

1. An assembly comprising:

a. a cigarette lighter; and b. a beverage container including:

a cylindrical container body defining an interior chamber that has a sealed bottom; and a C-shaped handle having a generally vertical gripping portion and two generally parallel horizontal portions that connect the gripping portion to the container body, the vertical gripping portion and horizontal portions defining a gripping opening through which fingers can be inserted, the gripping portion having a hollow interior defining a receiving space, the receiving space further including an opening through which the cigarette lighter can be passed, and a sealed bottom to retain the cigarette lighter inside the receiving space.

2. The assembly of claim 1, wherein the cigarette lighter is vertically oriented when it is retained inside the receiving space.

3. The assembly of claim 1, wherein the receiving space has an elongated cross-section.

4. The assembly of claim 1, wherein the container body, the handle, the horizontal portions and the gripping portion are provided in one piece.

* * * * *